US009284773B1

(12) United States Patent
Fridley et al.

(10) Patent No.: US 9,284,773 B1
(45) Date of Patent: Mar. 15, 2016

(54) LOCKING PET DOOR SYSTEM

(71) Applicants: Marlene E. Fridley, Fontana, CA (US); Jerry W. Fridley, Fontana, CA (US)

(72) Inventors: Marlene E. Fridley, Fontana, CA (US); Jerry W. Fridley, Fontana, CA (US)

( * ) Notice: Subject to any disclaimer, the term of this patent is extended or adjusted under 35 U.S.C. 154(b) by 81 days.

(21) Appl. No.: 14/058,313

(22) Filed: Oct. 21, 2013

Related U.S. Application Data

(63) Continuation-in-part of application No. 13/136,234, filed on Jul. 27, 2011, now abandoned.

(60) Provisional application No. 61/404,137, filed on Sep. 28, 2010.

(51) Int. Cl.

| | |
|---|---|
| ***E06B 7/28*** | (2006.01) |
| ***E06B 7/32*** | (2006.01) |
| ***E05F 13/00*** | (2006.01) |
| ***E05F 15/20*** | (2006.01) |

(52) U.S. Cl.
CPC . *E06B 7/32* (2013.01); *E05F 13/00* (2013.01); *E05F 15/2023* (2013.01); *E05F 15/2076* (2013.01)

(58) Field of Classification Search
CPC ..... E06B 7/32
USPC ..... 49/163, 169, 25; 160/180
See application file for complete search history.

(56) References Cited

U.S. PATENT DOCUMENTS

| | | | | |
|---|---|---|---|---|
| 4,022,263 | A * | 5/1977 | Beckett et al. | 160/92 |
| 4,216,743 | A * | 8/1980 | Cohen | 119/484 |
| 4,421,058 | A * | 12/1983 | Paul | 119/484 |
| 4,651,793 | A * | 3/1987 | Davlantes | 160/92 |
| 5,177,900 | A * | 1/1993 | Solowiej | 49/363 |
| 5,406,748 | A * | 4/1995 | Davlantes | 49/169 |
| 5,469,659 | A * | 11/1995 | Reid et al. | 49/169 |
| 5,946,856 | A * | 9/1999 | Davlantes | 49/168 |
| 5,992,096 | A * | 11/1999 | De La Cerda et al. | 49/169 |
| 6,141,911 | A * | 11/2000 | Reid | 49/394 |
| 7,765,955 | B2 * | 8/2010 | Brooks et al. | 119/484 |
| 7,913,454 | B2 * | 3/2011 | Sullivan | 49/169 |
| 8,240,085 | B2 * | 8/2012 | Hill | 49/169 |
| 2002/0196123 | A1 * | 12/2002 | Diehl et al. | 340/5.64 |
| 2003/0221631 | A1 * | 12/2003 | Yarbrough | 119/484 |
| 2005/0252622 | A1 * | 11/2005 | Reid | 160/180 |
| 2007/0234643 | A1 * | 10/2007 | Siegal et al. | 49/360 |
| 2008/0184940 | A1 * | 8/2008 | Bosserdet et al. | 119/484 |

* cited by examiner

*Primary Examiner* — Katherine Mitchell
*Assistant Examiner* — Scott Denion
(74) *Attorney, Agent, or Firm* — Ruth Eure; Emery L. Tracy

(57) ABSTRACT

A pet door system for allowing pets to enter and exit a building is provided. The pet door system comprises a pet door having a top edge, a pair of side edges, and a bottom edge with the pet door pivotally mounted within the opening. An aperture is formed in the top edge only of the pet door. A groove extends from along each side of the aperture. A plunger is moveable into and out of the aperture with the plunger riding in the groove. A solenoid moves the plunger into and out of the aperture with an activation mechanism activating the solenoid. Upon the activation mechanism being positioned within a predetermined distance from the pet door, the solenoid causes the plunger to automatically unlock the pet door. Upon the activation means being positioned outside the predetermined distance from the pet door, the solenoid causing the plunger to automatically lock the pet door.

18 Claims, 3 Drawing Sheets

LOCKING PET DOOR SYSTEM

The present application is a continuation-in-part of pending U.S. patent application Ser. No. 13/136,234, filed on Jul. 27, 2011, entitled "Locking Pet Door System", which claims the benefit of priority of provisional patent application Ser. No. 61/404,137, filed on Sep. 28, 2010, entitled "Automatic Locking Pet Door".

BACKGROUND OF THE INVENTION

1. Field of the Invention

This invention relates generally to a locking pet door system and, more particularly, the invention relates to a locking pet door system which automatically locks allowing only the pet, not raccoons and other unwanted pests, to enter and exit the residence.

2. Description of the Prior Art

It would be desirable to grant access for a pet cat or dog to enter and exit a home through a swinging pet door, while denying access to strays and wild animals. While there are many pet doors on the market, most allow access not only to household pets but also to uninvited mischief-makers, such as raccoons.

SUMMARY

The present invention is a pet door system for allowing pets to enter and exit a building. The building has an opening. The pet door system comprises a pet door having a top edge, a pair of side edges, and a bottom edge with the pet door pivotally mounted within the opening. An aperture is formed in the top edge only of the pet door. A groove extends from along each side of the aperture. A plunger is moveable into and out of the aperture with the plunger riding in the groove when out of the aperture. A solenoid moves the plunger into and out of the aperture with activation means activating the solenoid. Upon the activation means being positioned within a predetermined distance from the pet door with the solenoid causing the plunger to automatically unlock the pet door allowing the pet door to pivot within the opening. Upon the activation means being positioned outside the predetermined distance from the pet door with the solenoid causing the plunger to automatically lock the pet door preventing the pet door from pivoting within the opening.

In addition, the present invention includes a method for allowing pets to enter and exit a building. The building has an opening. The method comprises pivotally mounting a pet door within the opening, the pet door having a top edge, a pair of side edges, and a bottom edge, forming an aperture in the top edge only of the pet door, extending a groove extending along each side of the aperture, providing a plunger moveable into and out of the aperture with the plunger riding in the groove when out of the aperture, the plunger alternatingly locking and unlocking the pet door at the top edge only, positioning the pet adjacent the pet door, automatically unlocking the pet door, moving the pet away from the pet door, and automatically locking the pet door.

The present invention further includes a pet door system for allowing pets to enter and exit a building. The building has an opening. The pet door system comprises a first U-shaped flange for receiving a first side edge of the opening, a second U-shaped flange for receiving a second side edge of the opening, and a top U-shaped flange for receiving a top edge of the opening. A pet door is pivotally mounted within the opening between the flanges with the pet door having a plurality of edges. An aperture is formed in a top edge of the pet door with a groove extending from along each side of the aperture. A plunger alternatingly moves through the top flange into and out of the aperture for alternatingly locking and unlocking the pet door with the plunger riding in the groove when out of the aperture. An electronics box mounted in the top U-shaped flange with the electronics box containing a receiver and microprocessor and the microprocessor activating and deactivating the plunger. A transmitter adapted to be mounted to a pet transmits instructions to the receiver and microprocessor to activate the plunger. Upon the transmitter being positioned within a predetermined distance from the pet door, the plunger automatically moves out of the aperture to unlock the pet door allowing the pet door to pivot within the opening. Upon the transmitter being positioned outside the predetermined distance from the pet door, the plunger automatically moves into the aperture to lock the pet door preventing the pet door from pivoting within the opening.

DETAILED DESCRIPTION OF THE PREFERRED EMBODIMENTS

Figure 2:
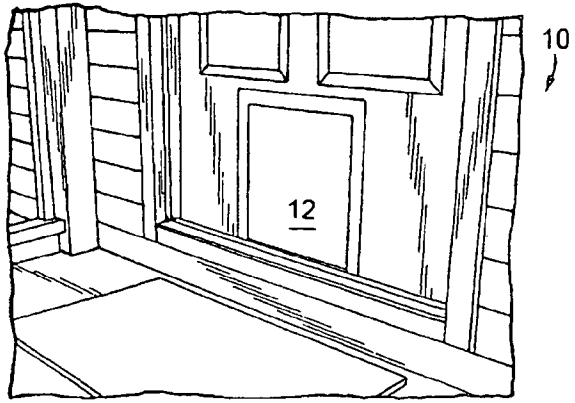
FIG. 2 is a perspective view illustrating the locking pet door system, constructed in accordance with the present invention, with a pet door in a locked condition.
Figure 3:
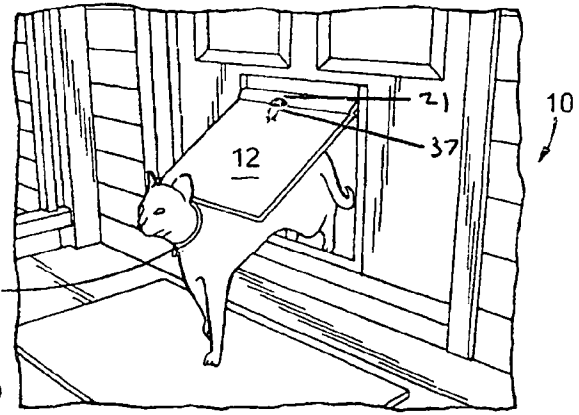
FIG. 3 is a perspective view illustrating the locking pet door system, constructed in accordance with the present invention, with a pet door in an unlocked condition.
Figure 1:
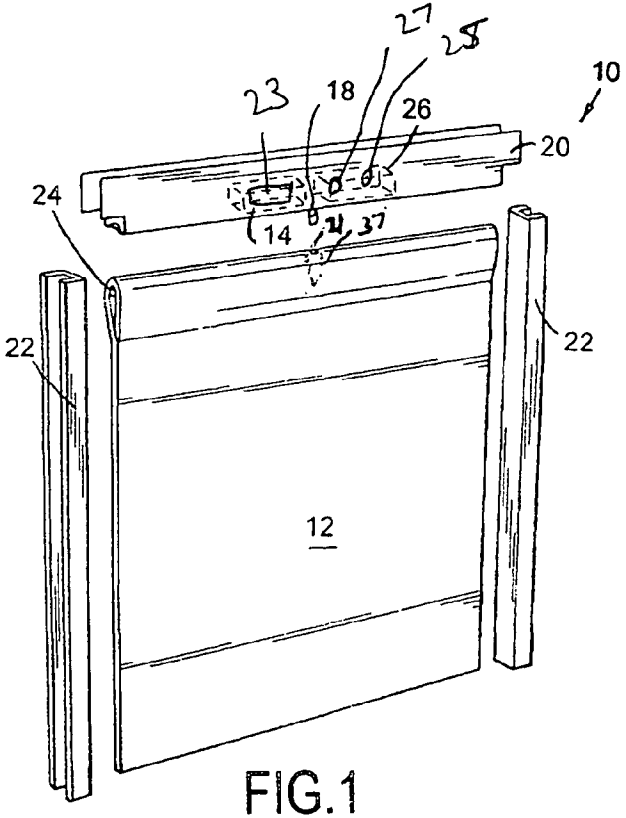
FIG. 1 is an exploded perspective view illustrating a locking pet door system, constructed in accordance with the present invention.
Figure 4:
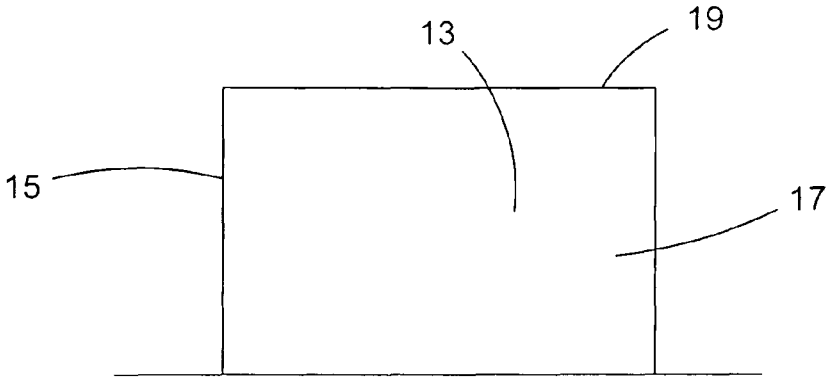
FIG. 4 is a front view illustrating an opening for receiving the locking pet door system, constructed in accordance with the present invention.
Figure 5:
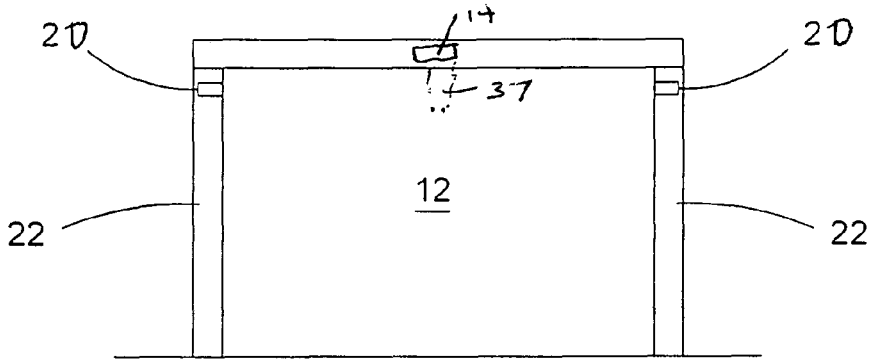
FIG. 5 is a front view illustrating the locking pet door system of FIG. 1, constructed in accordance with the present invention.
Figure 6:
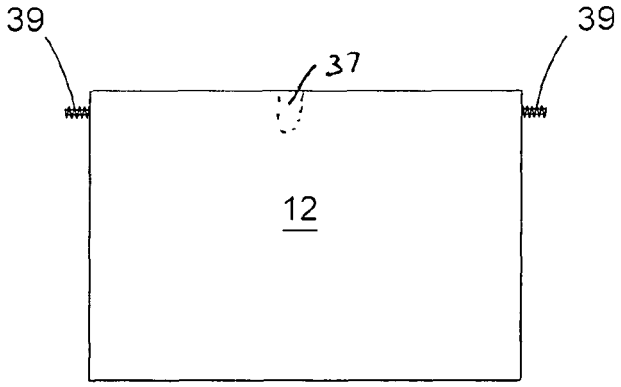
FIG. 6 is a front view illustrating the locking pet door system of FIG. 1, constructed in accordance with the present invention.
Figure 7:
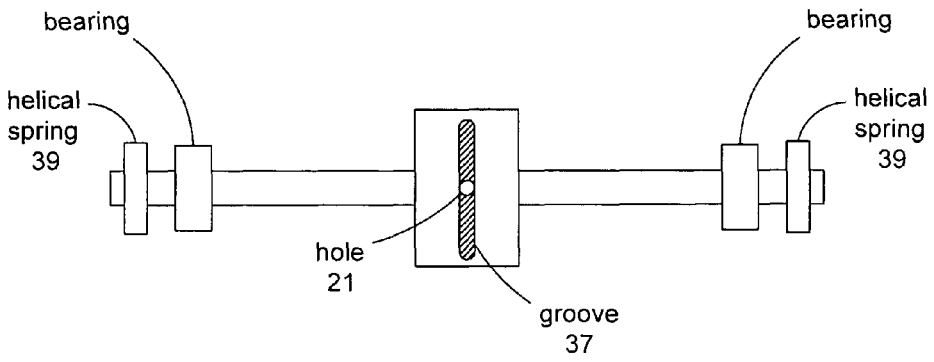
FIG. 7 is a top plan view illustrating the locking pet door system, constructed in accordance with the present invention, showing an aperture with a solenoid pin moving into the aperture to lock the pet door and lifts the solenoid pin to unlock; also shown is the groove that the solenoid pin rides in when the door is swung open with the groove to ensure the solenoid pin is guided into the locking hole when the door returns to the closed position.
Figure 8:
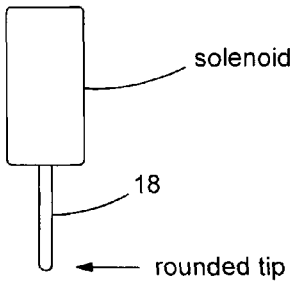
FIG. 8 is an elevational view illustrating the solenoid pin of the locking door assembly, constructed in accordance with the present invention, with the solenoid pin being rounded to fit into the groove for smooth operation.

As illustrated in FIGS. 1-3, the present invention is a locking pet door system, indicated generally at 10, which automatically locks allowing only the pet, not raccoons and other unwanted pests, to enter and exit the residence or other building. The pet door system 10 of the present invention has a top-hinged (optionally spring-loaded), swinging pet door 12 appropriate for mounting in doors and walls that automatically unlocks and locks in response to the proximity of certified pet(s) equipped with an Radio Frequency Identification (RFID) transmitter tag on their collar(s).

The locking pet door system 10 of the present invention consists of a main door assembly, a battery box 14, an RFID pet collar transmitter tag 16 or implant chip, a microprocessor working in conjunction with the RFID system, and a solenoid-type locking door mechanism 18. The tag 16 contains the RFID chip and slides onto or attaches to the pet collar or an RFID chip could be implanted in the pet. The RFID collar transmitter 16 and the RFID implant can use a small button-type battery. In addition, the transmitter 16 or RFID tag if implanted under the pet's skin, requires a veterinarian to implant and also change the battery when it goes low. Also, the working range of the RFID tag transmitter 16 is preferably no more than 18 inches. Passive tags (RFID tags that require no battery) can be used. Passive tags have no power source but use electromagnetic waves from the transponder to energize the chip and transmit back (backscatter) their data. Passive tags can be read up to approximately 10 feet from the transponder, which is well within the preferred 18-inch range. Use of the passive tags allows a pet owner to have their pet implanted with an RFID chip that does not require a battery change.

The main door assembly of the automatic locking pet door system 10 of the present invention can be installed in an exterior door or a wall and comes with a kit containing a template for proper sizing of an opening 13 having a first side edge 15, a second side edge 17, and a top edge 19. Three U-shaped flanges (a top flange 20 and two side flanges 22), preferably constructed of a plastic material, are trimmed to fit the sides and top of the hole, and the pet door 12 pivotally connected between the side flanges 22. In an embodiment of the pet door system 10, a single aperture 21 is formed only in the top edge of the pet door for receiving the plunger 18. The solenoid pin 18 moves into the aperture 21 to lock the pet door and lifts the solenoid pin 18 to unlock; also shown is the groove 37 that the solenoid pin 18 rides in when the pet door is swung open with the groove 37 to ensure the solenoid pin 18 is guided into the aperture 21 when the pet door returns to the closed position In another embodiment, a pin 24 extends from each side of the pet door 12 and is receivable within aligned apertures 21 formed in each of the side flanges 22. For a large dog, the pet door 12 preferably measures approximately twenty (20") inches in height by approximately eighteen (18") inches in width, while a small pet door 12 preferably measures approximately ten (10") inches in height by eight (8") inches in width. Regardless of installation frame size variations, the locking pet door assemblies 10 all feature the same components. The pet door 12 is preferably constructed from a durable, scratch- and impact-resistant injection-molded thermoplastic, laminated to a core of ¼-inch rigid Styrofoam. The large pet door 12 can be manufactured in a heavier grade injection-molded thermoplastic, due to its size.

The top flange 20 of the locking pet door system 10 of the present invention is preferably a compact, weather-resistant panel encasing three electronic components. The first component is the battery box 14 housing two 9-volt batteries 23 or the like and powering the receiver 25 and microprocessor 27. The second component, located in the approximate middle of the top flange 20 is the solenoid plunger 18. Preferably, the solenoid plunger 18 is spring-loaded to return to the extended or locked position when de-energized. When the solenoid plunger 18 is in the de-energized condition, it rides in a groove which extends 90° from the locking hole as the door opens. This ensures that the locking shaft on the solenoid tracks correctly to the locking hole in the door.

The top-center of the pet door 12 of the locking pet door system 10 of the present invention is fitted with a tubular sheath or channel to receive the solenoid plunger 18 when de-energized, and the pet door 12 is locked in its closed position. The door-hinge can be equipped with a helical spring 39 tensioned to restrict the pet door 12 swinging and to quickly return the pet door 12 to the vertical, at which point the solenoid pin locks the pet door 12.

The third electronic component of the locking pet door system 10 of the present invention is the electronics box 26 containing the microprocessor 27 and the RFID transponder. The microprocessor 27 activates and de-activates the solenoid door-locking plunger 18 when the pet door 18 is in proper alignment or when so instructed via the RFID system. Once the pet wearing the RFID tag 16 approaches within approximately eighteen (18") inches of the pet door 18, the RFID transponder reads, via reflected radio signals, the RFID tag on the pet's collar. The RFID transmitter 16 sends out a radio signal on a particular frequency, and the RFID tag 16 reflects this signal back to the main unit, recognizing the frequency as its own. Once the RFID unit detects a corresponding RFID tag 16 in its given range, which is about eighteen (18") inches, the RFID unit signals the microprocessor 27 to activate the solenoid, lifting the plunger 18 or shaft, and allowing the dog or cat to pass through the door; and once the pet moves out of range the sensor de-energizes the solenoid thereby locking out raccoons, squirrels, and other pests.

As noted earlier, while the RFID tags 16 of the locking pet door system 10 of the present invention can be "passive" and require no power source, a power source is required to operate the transmitter/receiver (or transponder) of the main unit, the microprocessor, and the solenoid lock. Two 9-volt batteries and also a "battery eliminator" are provided with an 110 vAC/9 vDC wall-plug transformer (or power rectifier) with a cord that plugs into the door unit.

The locking pet door system 10 of the present invention, an RFID door system allowing pet dogs and cats to come and go at will, offers users distinct and significant benefits and advantages. Foremost, the locking pet door system 10 allows pets the ability to go outside and come inside, on their own, whenever they approach the door wearing their tagged collars. The locking pet door system 10 represents a dramatic improvement of the many pet doors currently on the market, which allow only for one-way access and are not good for the cat or dog caught outside in a sudden squall, storm, or inclement weather. Furthermore, the locking pet door system 10 will appeal to pet owners concerned with raccoons and other wildlife entering through a pet door. The RFID technology allows for pet-identification before the pet door will lock and unlock, thereby preventing uninvited guests sneaking through. Since the locking mechanism is controlled by the pet tag's proximity to the door, pet owners can have peace of mind knowing that only their pets have the freedom to come and go as they please.

Most existing pet doors are hinged from the top and hang freely in a vertical position. By mounting pet doors in this manner, dirt and debris are allowed to blow into the residence. With the locking pet door system 10 of the present invention, when closed and locked, dirt and debris are inhibited from entering the residence.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein may be suitably practiced in the absence of the specific elements which are disclosed herein.

What is claimed is:

1. A pet door system for allowing pets to enter and exit a building, the building having an opening, the pet door system comprising:

a pet door having a top edge, a pair of side edges, and a bottom edge, the pet door pivotally mounted within the opening;

an aperture formed in the top edge and extending into a top portion of the pet door;

a groove extending from along each side of the aperture;

a plunger moveable into and out of the aperture, the plunger riding in the groove when out of the aperture;

a solenoid for moving the plunger into and out of the aperture;

activation means for activating the solenoid;

wherein upon the activation means being positioned within a predetermined distance from the pet door, the solenoid causes the plunger to automatically unlock the pet door allowing the pet door to pivot within the opening; and wherein upon the activation means being positioned outside the predetermined distance from the pet door, the solenoid causing the plunger to automatically lock the pet door preventing the pet door from pivoting within the opening.

2. The pet door system of claim 1 and further comprising:

a first U-shaped flange for receiving a first side edge of the opening;

a second U-shaped flange for receiving a second side edge of the opening; and a top U-shaped flange for receiving a top edge of the opening;

3. The pet door system of claim 2 and further comprising:

a first pin extending from one side of the pet door;

a first receiving aperture formed in the first U-shaped flange, the first pin receivable within the first receiving aperture;

a second pin extending from another side of the pet door; and a second receiving aperture formed in the second U-shaped flange, the second pin receivable within the second receiving aperture;

wherein the interaction of the pins in the receiving apertures allows the pet door to freely pivot within the opening upon deactivation of the solenoid and plunger.

4. The pet door system of claim 2 and further comprising:

an electronics box mounted in the top U-shaped flange, the electronics box contains a receiver and microprocessor, the microprocessor activating and deactivating the solenoid and plunger.

5. The pet door system of claim 2 and further comprising:

a battery box mounted in the top U-shaped flange, the battery box housing at least one battery for powering the solenoid and plunger.

6. The pet door system of claim 1 wherein the activation means is a transmitter adapted to be positioned on the pet such that upon the pet having the transmitter approaches within a predetermined distance of the pet door, locking means comprising the solenoid and the plunger is deactivated and pet door is able to swing freely.

7. The pet door system of claim 6 wherein the transmitter is adapted to be positioned on a collar of the pet or under the skin of the pet.

8. The pet door system of claim 1 wherein the pet door has a helical spring tensioned to restrict the pet door from easily swinging and allowing the pet door to slowly return to the closed position after it has been opened.

9. A pet door system for allowing pets to enter and exit a building, the building having an opening, the pet door system comprising:

a first U-shaped flange for receiving a first side edge of the opening;

a second U-shaped flange for receiving a second side edge of the opening;

a top U-shaped flange for receiving a top edge of the opening;

a pet door pivotally mounted within the opening between the flanges, the pet door having a plurality of edges;

an aperture formed in a top edge of the pet door and extending into a top portion of the pet door;

a groove extending from along each side of the aperture;

a plunger alternatingly moveable through the top flange into and out of the aperture for alternatingly locking and unlocking the pet door, the plunger riding in the groove when out of the aperture;

an electronics box mounted in the top U-shaped flange, the electronics box containing a receiver and microprocessor, the microprocessor activating and deactivating the plunger;

a transmitter adapted to be mounted to a pet, the transmitter transmitting instructions to the receiver and microprocessor to activate the plunger;

wherein upon the transmitter being positioned within a predetermined distance from the pet door, the plunger automatically moves out of the aperture to unlock the pet door allowing the pet door to pivot within the opening; and wherein upon the transmitter being positioned outside the predetermined distance from the pet door, the plunger automatically moves into the aperture to lock the pet door preventing the pet door from pivoting within the opening.

10. The pet door system of claim 9 wherein the transmitter is adapted to be positioned on a collar of the pet or under the skin of the pet.

11. A method for allowing pets to enter and exit a building, the building having an opening, the method comprising:

using the pet door system of claim 1, positioning the pet adjacent the pet door;

automatically unlocking the pet door;

moving the pet away from the pet door; and automatically locking the pet door.

12. The method of claim 11 and further comprising:

providing a first U-shaped flange for receiving a first side edge of the opening;

providing a second U-shaped flange for receiving a second side edge of the opening; and providing a top U-shaped flange for receiving a top edge of the opening.

13. The method of claim 12 and further comprising:

extending a first pin from one side of the pet door;

forming a first receiving aperture in the first U-shaped flange;

positioning the first pin within the first receiving aperture;

extending a second pin from another side of the pet door;

forming a second receiving aperture in the second U-shaped flange;

positioning the second pin within the second receiving aperture; and allowing the pet door to freely pivot within the opening.

14. The method of claim 12 and further comprising:

positioning the plunger within the top U-shaped flange;

alternatingly moving the plunger into and out of the opening;

mounting an electronics box mounted in the top U-shaped flange;

positioning a receiver and microprocessor within the electronics box; and activating and deactivating the lock with the microprocessor.

15. The method of claim 12 and further comprising:

mounting a battery box mounted in the top U-shaped flange, the battery box housing at least one battery.

16. The method of claim 11 and further comprising:

adapting a transmitter to be positioned on the pet such that upon the pet having the transmitter approaches within a predetermined distance of the pet door, the pet door swings freely.

17. The method of claim 16 wherein the transmitter is adapted for being positioned on a collar of the pet or under the skin of the pet.

18. The method of claim 16 and further comprising:

mounting a helical spring in the pet door;

restricting the pet door from easily swinging; and returning the pet door to the closed position after it has been opened.

* * * * *